US009163624B2

(12) United States Patent
Chen

(10) Patent No.: US 9,163,624 B2
(45) Date of Patent: Oct. 20, 2015

(54) VIBRATION FAN WITH MOVABLE MAGNETIC COMPONENT

(75) Inventor: Shih-Chou Chen, Taoyuan Hsien (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 383 days.

(21) Appl. No.: 13/615,566

(22) Filed: Sep. 13, 2012

(65) Prior Publication Data

US 2013/0309107 A1 Nov. 21, 2013

(30) Foreign Application Priority Data

May 15, 2012 (TW) ..... 101117290 A

(51) Int. Cl.
*F04B 45/047* (2006.01)
*F04F 7/00* (2006.01)
*F04D 33/00* (2006.01)

(52) U.S. Cl.
CPC ..... *F04B 45/047* (2013.01); *F04D 33/00* (2013.01); *F04F 7/00* (2013.01)

(58) Field of Classification Search
CPC ..... F04D 33/00; F04D 43/046; F04D 43/04; F04D 17/16; F04B 45/047; F04F 7/00; F04C 9/002
USPC ..... 417/410.1, 410.2, 436; 310/15, 20, 25, 310/36, 345
See application file for complete search history.

(56) References Cited

U.S. PATENT DOCUMENTS

| | | | | |
|---|---|---|---|---|
| 4,193,740 | A | 3/1980 | Charles | |
| 5,104,626 | A * | 4/1992 | Yang | 422/124 |
| 5,247,129 | A * | 9/1993 | Nozaki et al. | 84/615 |
| 5,522,712 | A * | 6/1996 | Winn | 417/436 |
| 6,326,706 | B1 * | 12/2001 | Zhang | 310/12.31 |
| 2009/0072637 | A1 * | 3/2009 | Chang et al. | 310/36 |
| 2009/0086416 | A1 * | 4/2009 | Ishikawa et al. | 361/679.01 |
| 2009/0121567 | A1 * | 5/2009 | Chou et al. | 310/77 |
| 2009/0169387 | A1 | 7/2009 | Yoo et al. | |
| 2010/0196173 | A1 * | 8/2010 | Gromoll | 417/410.1 |
| 2011/0005733 | A1 | 1/2011 | Wada et al. | |

FOREIGN PATENT DOCUMENTS

| | | | |
|---|---|---|---|
| TW | M271368 | U | 7/2005 |
| TW | I298296 | B | 7/2008 |
| TW | 200946783 | A | 11/2009 |
| TW | I328735 | B | 8/2010 |

OTHER PUBLICATIONS

BEI Kimco Magnetics, Linear Actuator, Oct. 6, 2005.*
BEI Kimco Magnetics, Kimco Archived File from Wayback Machine, Dec. 3, 2010.*

* cited by examiner

*Primary Examiner* — Charles Freay
*Assistant Examiner* — Jon Hoffmann
(74) *Attorney, Agent, or Firm* — CKC & Partners Co., Ltd.

(57) ABSTRACT

A vibration fan includes a base, an electromagnetic actuator and a blade. The electromagnetic actuator is disposed on the base, and includes a movable magnetic component and a fixed magnetic component. The movable magnetic component reciprocates relative to the fixed magnetic component. The blade is connected to the movable magnetic component.

18 Claims, 14 Drawing Sheets

VIBRATION FAN WITH MOVABLE MAGNETIC COMPONENT

RELATED APPLICATIONS

This application claims priority to Taiwan Application Ser. No. 101117290, filed May 15, 2012, which is herein incorporated by reference.

BACKGROUND

1. Technical Field

Embodiments of the present invention relate to a fan. More particularly, embodiments of the present invention relate to a vibration fan.

2. Description of Related Art

In order to enable easy carrying of portable devices, portable devices are being developed having configurations that are increasingly lighter and thinner. Because the physical size of portable devices is getting smaller, the demands for heat dissipation are increasing. Therefore, heat dissipation technology is an important field.

A portable device generally employs a centrifugal fan to dissipate heat. A blade of the centrifugal fan rotates in a flow channel, and consequently generates air flow and also directs the air flow towards a ventilation orifice, thereby dissipating heat to the external environment by heat convection.

However, although the centrifugal fan can effectively generate and direct air flow to dissipate heat, the rotating blade generates an annoying noise. Further, minimizing the size of the centrifugal fan is not easy because a bearing and a rotating blade are necessary elements therein, and therefore, the centrifugal fan may impede miniaturization of the portable device. Still further, if the height of the bearing of the centrifugal fan is reduced in an effort to minimize the size of the centrifugal fan, the strength of the bearing may be decreased, and hence, the bearing may be damaged easily, thereby reducing the life of the centrifugal fan.

Some manufacturers utilize piezoelectric fans to dissipate heat, such as the piezoelectric fan disclosed in U.S. Patent Publication No. 2010/0150753 and entitled "Oscillating Diaphragm Fan Having Coupled Subunits and a Housing Having an Oscillating Diaphragm Fan of this Type." Typically, a piezoelectric fan has to provide a high voltage to deform the piezoelectric material, so as to agitate air and generate air flow. If the piezoelectric fan is installed in a portable device, a considerable amount of power may be consumed, resulting in draining of the battery in a short time. Therefore, the piezoelectric fan is not suitable for use in a portable device.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In accordance with one embodiment of the present invention, a vibration fan includes a base, an electromagnetic actuator and a blade. The electromagnetic actuator is disposed on the base, and includes a movable magnetic component and a fixed magnetic component. The movable magnetic component is driven by a magnetic force between the movable magnetic component and the fixed magnetic component to reciprocate relative to the fixed magnetic component. The blade is connected to the movable magnetic component.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
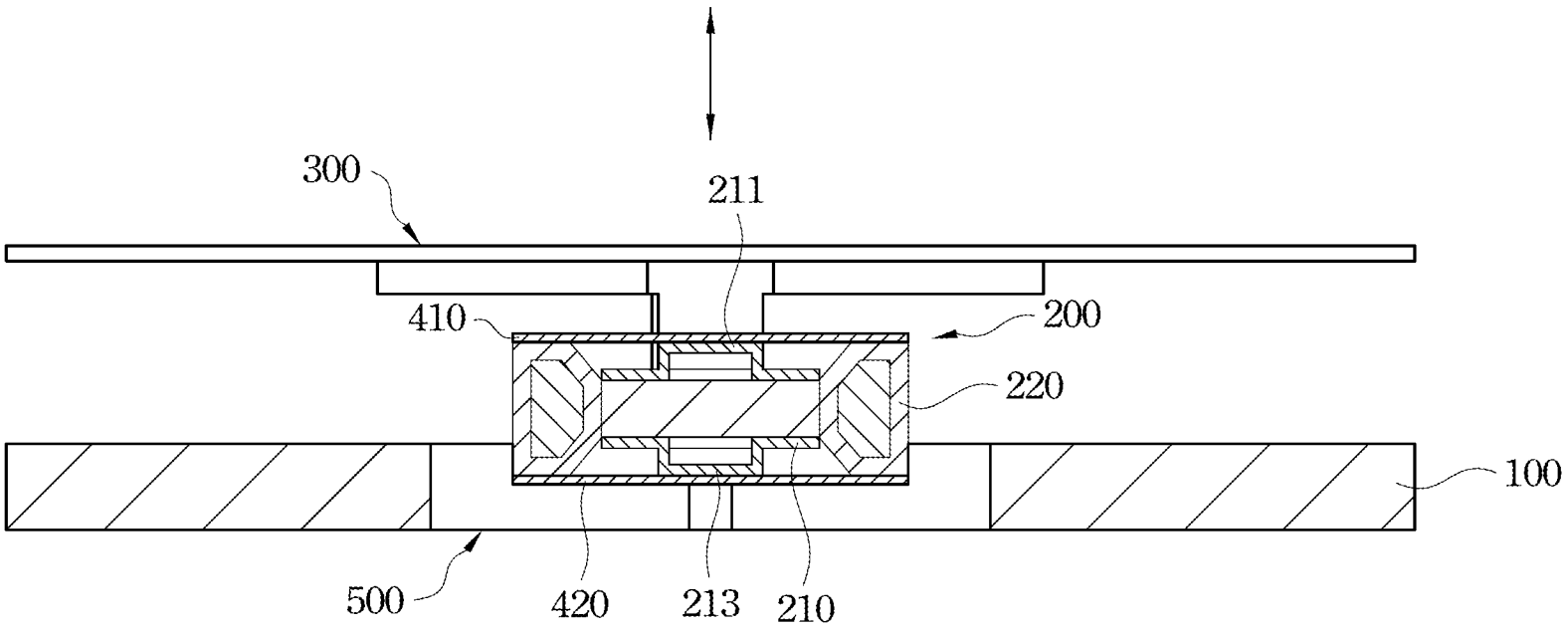
FIG. 1 is a cross-sectional view of a vibration fan in accordance with one embodiment of the present invention.

Reference will now be made in detail to the present embodiments of the invention, examples of which are illustrated in the accompanying drawings. Wherever possible, the same reference numbers are used in the drawings and the description to refer to the same or like parts.

FIG. 1 is a cross-sectional view of a vibration fan in accordance with one embodiment of the present invention. As shown in this figure, the vibration fan includes a base 100, an electromagnetic actuator 200 and a blade 300. The electromagnetic actuator 200 is disposed on the base 100, and includes a movable magnetic component 210 and a fixed magnetic component 220. The movable magnetic component 210 is driven by a magnetic force between the movable magnetic component 210 and the fixed magnetic component 220 to reciprocate relative to the fixed magnetic component 220. The blade 300 is connected to the movable magnetic component 210.

The aforementioned embodiment of the present invention can utilize the reciprocation motion of the movable magnetic component 210 to drive the blade 300 to oscillate back and forth shown by the arrow above the blade 300, so that air can be agitated and heat can be dissipated.

Figure 2:
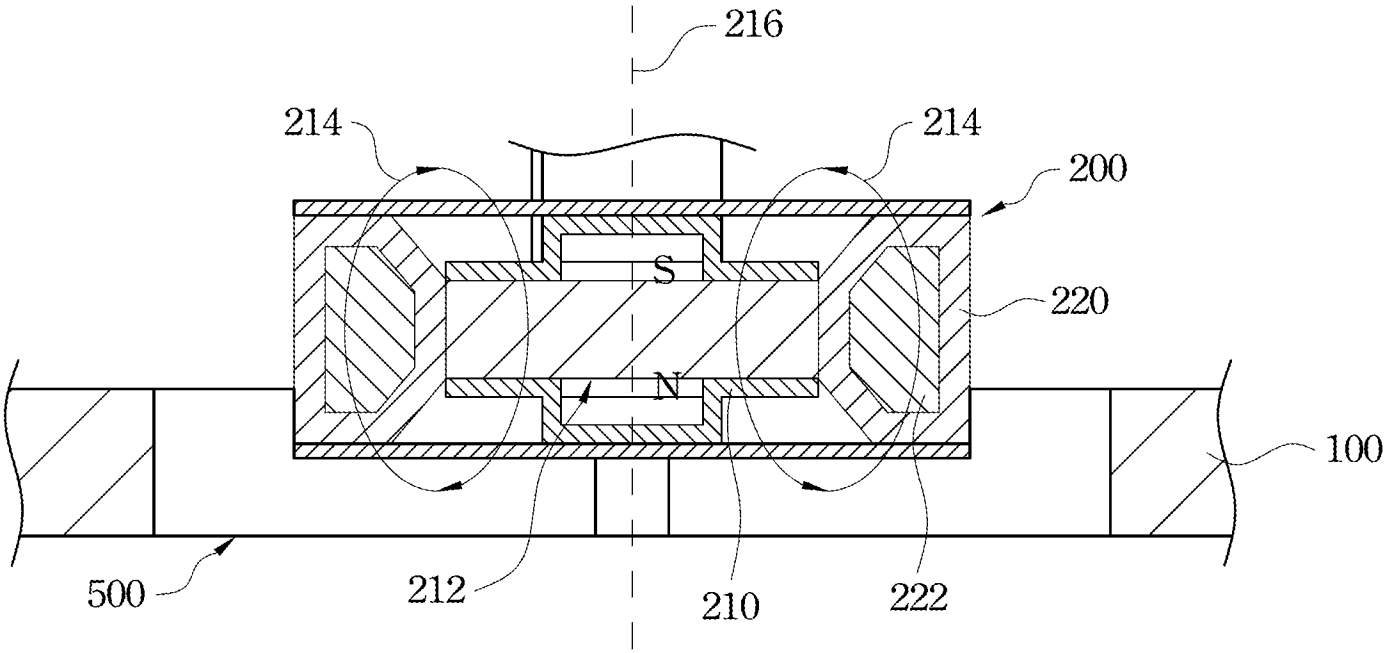
FIG. 2 is a partial cross-sectional view of the vibration fan of FIG. 1.

FIG. 2 is a partial cross-sectional view of the vibration fan of FIG. 1. As shown in FIG. 2, the fixed magnetic component 220 can be fixed on the base 100 and surrounds the movable magnetic component 210. The magnetic force that is attractive or repulsive is generated between the fixed magnetic component 220 and the movable magnetic component 210. Because the fixed magnetic component 220 is fixed on the base 100, the magnetic force that is attractive or repulsive can drive the movable magnetic component 210 to move.

In some embodiments, the movable magnetic component 210 comprises a magnet 212, and the fixed magnetic component 220 comprises a coil 222. The magnet 212 axially moves relative to the coil 222 when the coil 222 is conducting. It should be noted that "axially" refers to the direction parallel to the axis 216 of the movable magnetic component 210. In other words, when the coil 222 is conducting, a magnetic force is generated due to electromagnetic induction, and the magnetic force can interact with the inherent magnetic force of the magnet 212, so that the movable magnetic component 210 can be driven along the direction parallel to the axis 216.

Specifically, magnetic poles of the magnet 212 can be formed on opposite surfaces on the magnet 212, and magnetic field lines 214 can be formed as shown in FIG. 2. The direction of the current conducting in the coil 222 is perpendicular to the magnetic field lines 214. According to Ampere's circuital law, the magnetic field arising from the coil 222 is parallel to the magnetic field lines 214 of the magnet 212, so that an attractive or repulsive force is generated therebetween. As a result, the movable magnetic component 210 can move along the direction parallel to the axis 216.

It should be noted that the term "substantially" as used herein refers to a situation in which a minor variation or modification not affecting the essence of the technical feature can be included in the scope of the present invention. For example, when stating that the direction of the current conducting in the coil 222 is "substantially" perpendicular to the magnetic field lines 214, this not only includes an embodiment in which an angle between the direction of the current conducting in the coil 222 and the magnetic field lines 214 is exactly 90 degrees, but also includes embodiments in which the angle between the current conducting in the coil 222 and the magnetic field lines 214 is not 90 degrees, as long as the magnetic field generated by the coil 222 can attract or repulse the magnet 212 to make the movable magnetic component 210 move along the direction parallel to the axis 216.

Figure 3:
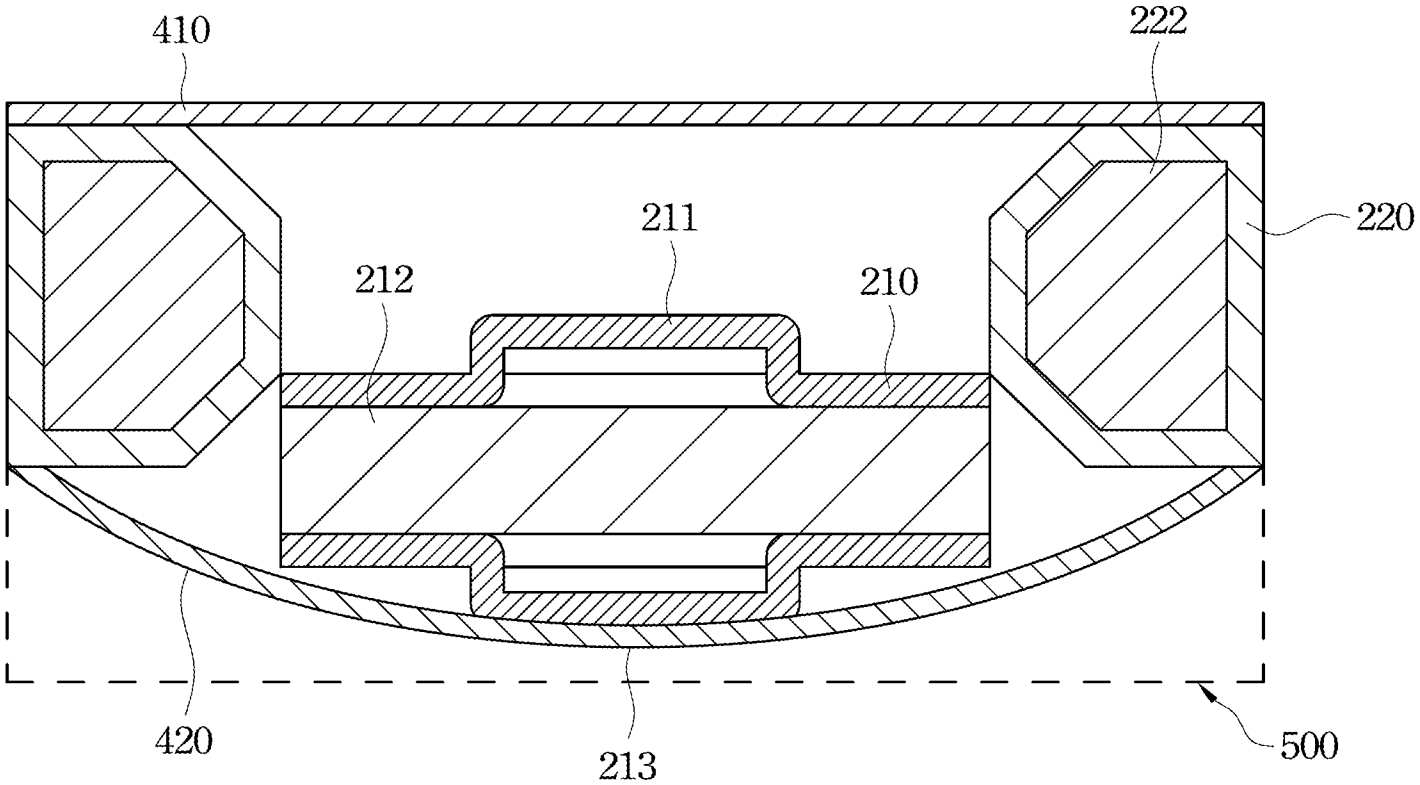
FIG. 3 is a cross-sectional view of one transient state of an electromagnetic actuator of FIG. 2.

FIG. 3 is a cross-sectional view of one transient state of the electromagnetic actuator 200 of FIG. 2. As shown in FIG. 3, when the coil 222 is conducting, the magnet 212 can be repulsed, and as a result, the movable magnetic component 210 is moved downwards. When the movable magnetic component 210 moves downwards to a particular location, the magnetic pole on the upper surface of the magnet 212 can be attracted by the magnetic field generated by the coil 222, and as a result, the movable magnetic component 210 moves back, that is, upwards.

Figure 4:
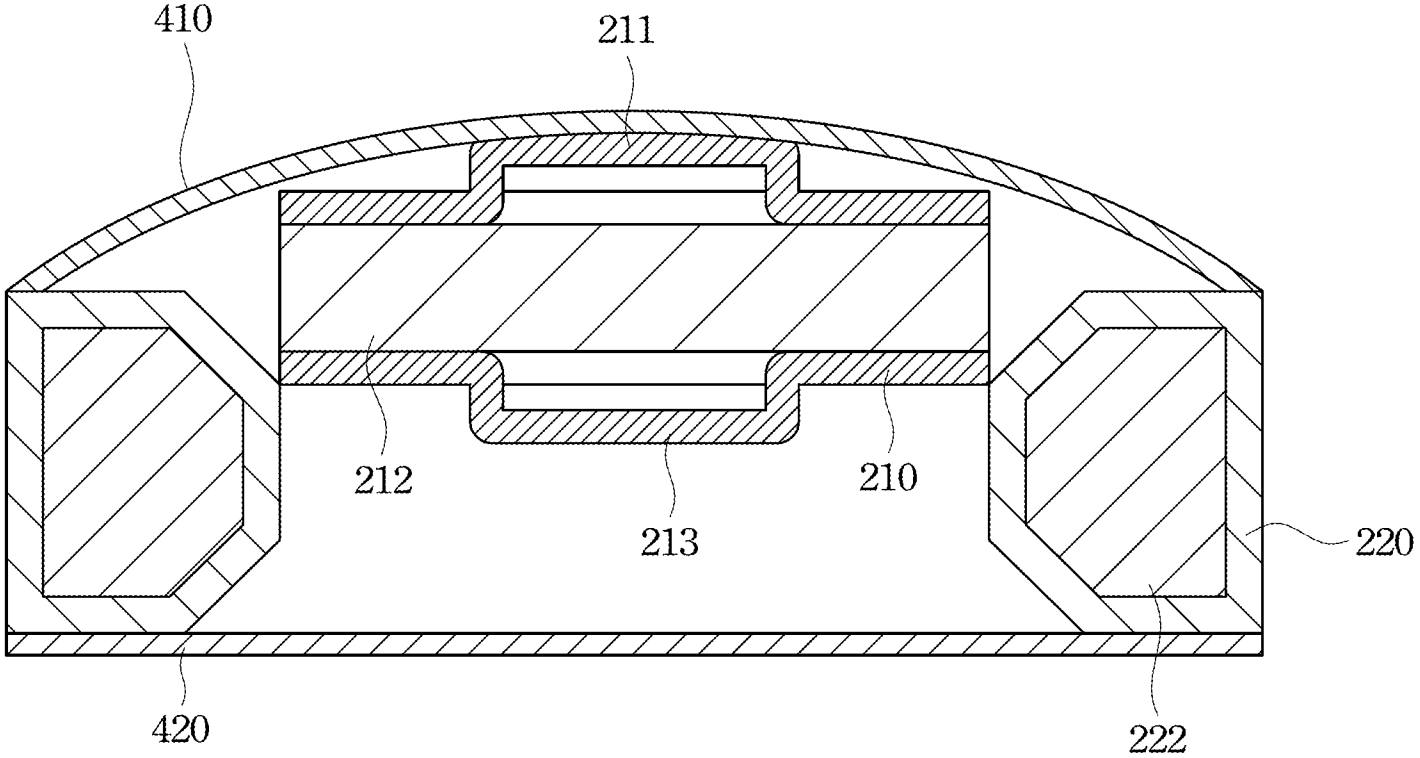
FIG. 4 is a cross-sectional view of another transient state of the electromagnetic actuator of FIG. 2.

FIG. 4 is a cross-sectional view of another transient state of the electromagnetic actuator 200 of FIG. 2. The main difference between this figure and FIG. 3 is that the magnet 212 in this figure is repulsed such that the movable magnetic component 210 moves upwards. When the movable magnetic component 210 moves upwards to a particular location, the magnetic pole on the lower surface of the magnet 212 can be attracted by the magnetic field generated by the coil 222, and as a result, the movable magnetic component 210 moves back, that is, downwards.

Referring FIGS. 2, 3, and 4, it should be understood that the attractive or repulsive force arising between the magnetic field generated by the coil 222 and the magnetic field lines 214 of the movable magnetic component 210 can drive the movable magnetic component 210 to reciprocate along the direction parallel to the axis 216, so that the blade 300 (See FIG. 1) can oscillate and agitate air for dissipating heat.

Referring back to FIG. 1, in some embodiments, the vibration fan may further include two position-limiting elastic sheets 410 and 420 for limiting movement of the movable magnetic component 210. For example, the position-limiting elastic sheet 410 and the position limiting elastic sheet 420 can respectively be disposed on opposite sides of the electromagnetic actuator 200, and they can be at least positioned on the axis 216 (See FIG. 2) of the movable magnetic component 210, so as to prevent the movable magnetic component 210 from being removed from the electromagnetic actuator 200 when the magnetic force is too strong. It should be noted that "movement" as used herein refers to the displacement of the movable magnetic component 210 in one direction, and not the total distance of the reciprocation motion.

In this embodiment, the vibration fan may further include two protrusions 211 and 213 disposed on opposite sides of the movable magnetic component 210 and which respectively press against the position-limiting elastic sheets 410 and 420.

Specifically, the protrusions 211 and 213 are respectively protruded on opposite surfaces of the movable magnetic component 210. The protrusions 211 and 213 are at the same height respectively with the upper surface and the lower surface of the fixed magnetic component 220. Due to the presence of the protrusions 211 and 213, when the movable magnetic component 210 and the fixed magnetic component 220 are static, the position-limiting elastic sheets 410 and 420 do not deform.

Referring to FIG. 3 and FIG. 4, in this embodiment, the material of the position-limiting elastic sheets 410 and 420 may include, but is not limited to including, elastic material, such as PC (polycarbonate), or ultra-thin metal. When the movable magnetic component 210 moves downwards and the protrusion 213 presses against the position-limiting elastic sheet 420, the position-limiting elastic sheet 420 may be concave. Similarly, when the movable magnetic component 210 moves upwards and the protrusion 211 presses against the position-limiting elastic sheet 410, the position-limiting elastic sheet 410 may be convex. Therefore, the position-limiting elastic sheets 410 and 420 can provide elasticity that facilitates the reciprocating motion of the movable magnetic component 210.

In some embodiments, the vibration fan may further include a buffering space 500 formed in the base 100 (See FIG. 1 or FIG. 2). The position-limiting elastic sheet 420 may deform towards the buffering space 500. The movable magnetic component 210 can pass into the buffering space 500, so as to make the blade 300 (See FIG. 1) move downwards. Specifically, the axis 216 of the movable magnetic component 210 extends through the buffering space 500, so that the movable magnetic component 210 can pass into the buffering space 500.

Figure 5:
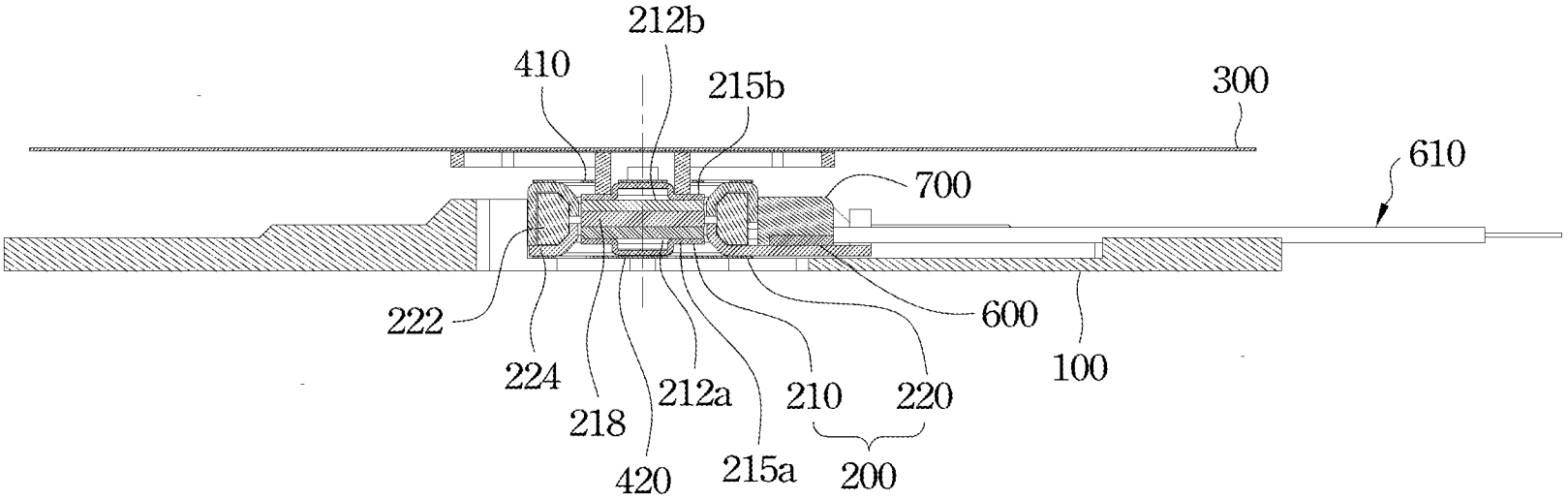
FIG. 5 is a cross-sectional view of the vibration fan in accordance with another embodiment of the present invention.

FIG. 5 is a cross-sectional view of the vibration fan in accordance with another embodiment of the present invention. This embodiment is similar to that of FIG. 1, and the main difference is the configuration of the electromagnetic actuator 200. In this embodiment, the electromagnetic actuator 200 also includes a movable magnetic component 210 and a fixed magnetic component 220. The movable magnetic component 210 may include a first magnet 212*a*, a second magnet 212*b*, and a middle yoke 218. The middle yoke 218 is disposed between the first magnet 212*a* and the second magnet 212*b*.

In this embodiment, the movable magnetic component 210 may further include a first yoke 215*a* and a second yoke 215*b*. The first yoke 215*a* is disposed on a surface of the first magnet 212*a* opposite a surface thereof adjacent to the middle yoke 218. The second yoke 215*b* is disposed on a surface of the second magnet 212*b* opposite a surface thereof adjacent to the middle yoke 218.

In this embodiment, the fixed magnetic component 220 may include a coil 222 and an outer yoke 224. The outer yoke 224 covers the coil 222. In this embodiment, the middle yoke 218 the first yoke 215*a*, the second yoke 215*b* and the outer yoke 224 can assist electromagnetic induction, so as to help the blade 300 to oscillate.

In this embodiment, the vibration fan may include a circuit board 600 and a wire 610. The wire 610 can be electrically connected to the circuit board 600, and the circuit board 600 can be electrically connected to the coil 222 of the fixed magnetic component 220. Therefore, the wire 610 can transmit power to the coil 222 for electromagnetic induction, thereby driving the movable magnetic component 210 to reciprocate and making the blade 300 oscillate. To provide examples with respect to the circuit board 600 and the wire 610, the circuit board 600 may be a PCB (printed circuit board), and the wire 610 can be covered in an insulated material, such as polyvinylchloride.

In this embodiment, the vibration fan may include at least one support 700. The support 700 presses against the fixed magnetic component 220. Specifically, the support 700 surrounds the outer surface of the fixed magnetic component 220, that is, the surface of the fixed magnetic component 220 opposite to the movable magnetic component 210. The support 700 can be made of epoxy, for example. In this embodiment, the circuit board 600 can be embedded in the support 700.

Figure 6:
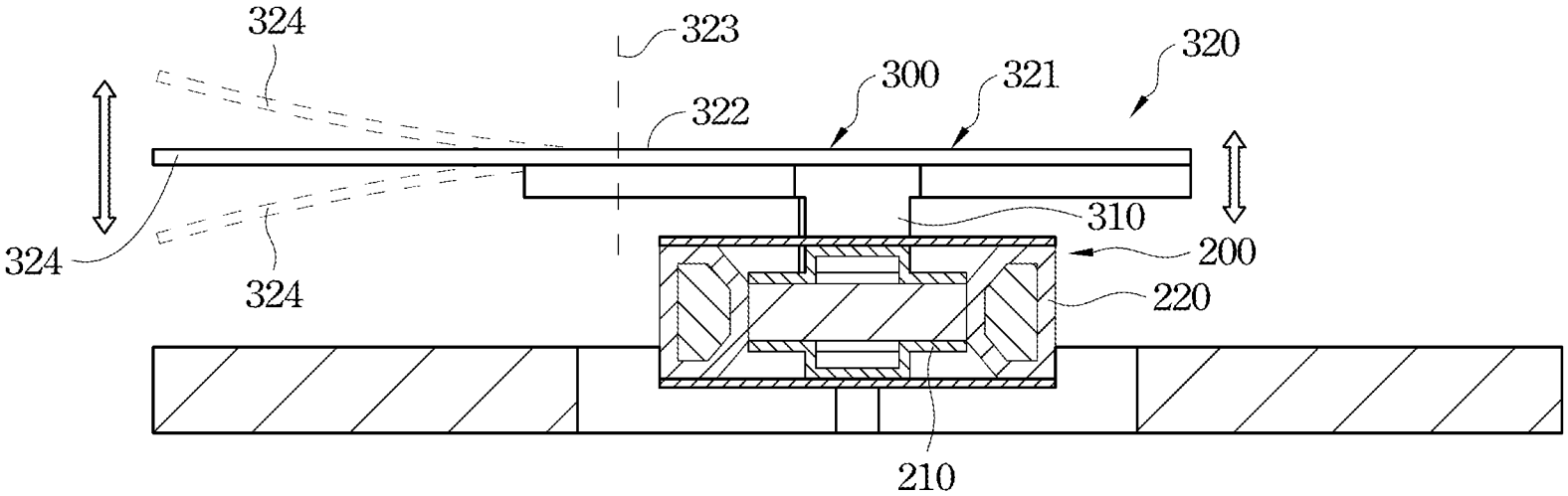
FIG. 6 is a cross-sectional view of the vibration fan in accordance with another embodiment of the present invention.

FIG. 6 is a cross-sectional view of the vibration fan in accordance with another embodiment of the present invention. In this embodiment, the blade 300 may include a blade mount 310 and a blade body 320. The blade mount 310 is connected to the movable magnetic component 210. The blade body 320 is disposed on the blade mount 310.

In some embodiments, the blade body 320 may include a fixed part 322 and a free part 324. The fixed part 322 is fixed on the blade mount 310. The free part 324 is connected to the fixed part 322 and is not physically contacted with the blade mount 310. The movement of the free part 324 (See the arrow to the left of the blade body 320 in FIG. 6) is greater than movement of the movable magnetic component 210 (See the arrow to the right of the blade body 320 in FIG. 6).

The material of the free part 324 of the blade body 320 may include, but is not limited to including, elastic material, such as PC (polycarbonate), or ultra-thin metal. When the movable magnetic component 210 reciprocates, the fixed part 322 and the free part 324 of the blade body 320 can consequently reciprocate. Because the free part 324 is elastic and not fixed on the blade mount 310, it may deform to swing (See the dashed lines in FIG. 6) in addition to undergoing reciprocation motion resulting from the corresponding movement of the movable magnetic component 210. Therefore, the movement of the free part 324 can be greater than that of the movable magnetic component 210, thereby facilitating the flow of air and heat dissipation. In some embodiments, the portion of the free part 324 that is farthest away from the fixed part 322 undergoes the greatest swinging motion (i.e., moves the most), and such operation results in a better heat dissipation ability of the vibration fan.

The blade body 320 includes a main surface 321. The main surface 321 refers to the surface with the greatest area on the blade body 320. In some embodiments, the main surface 321 can be substantially perpendicular to the movement direction of the movable magnetic component 210. In other words, the main surface 32 can be substantially perpendicular to the axis 216 (See FIG. 2) of the movable magnetic component 210.

In some embodiments, the main surface 321 has a central line 323. The central line 323 is through the center of the main surface 321. The blade mount 310 deviates from the central line 323. For example, the blade mount 310 can be positioned on one side of the central line 323, and the free part 324 can be positioned on another side of the central line 323. The longer the distance between the blade mount 310 and the free part 324, the greater the swing motion of the free part 324. Preferably, the blade mount 310 can be positioned on the rim of the blade body 320, so as to increase the swinging range of the free part 324.

Figure 7:
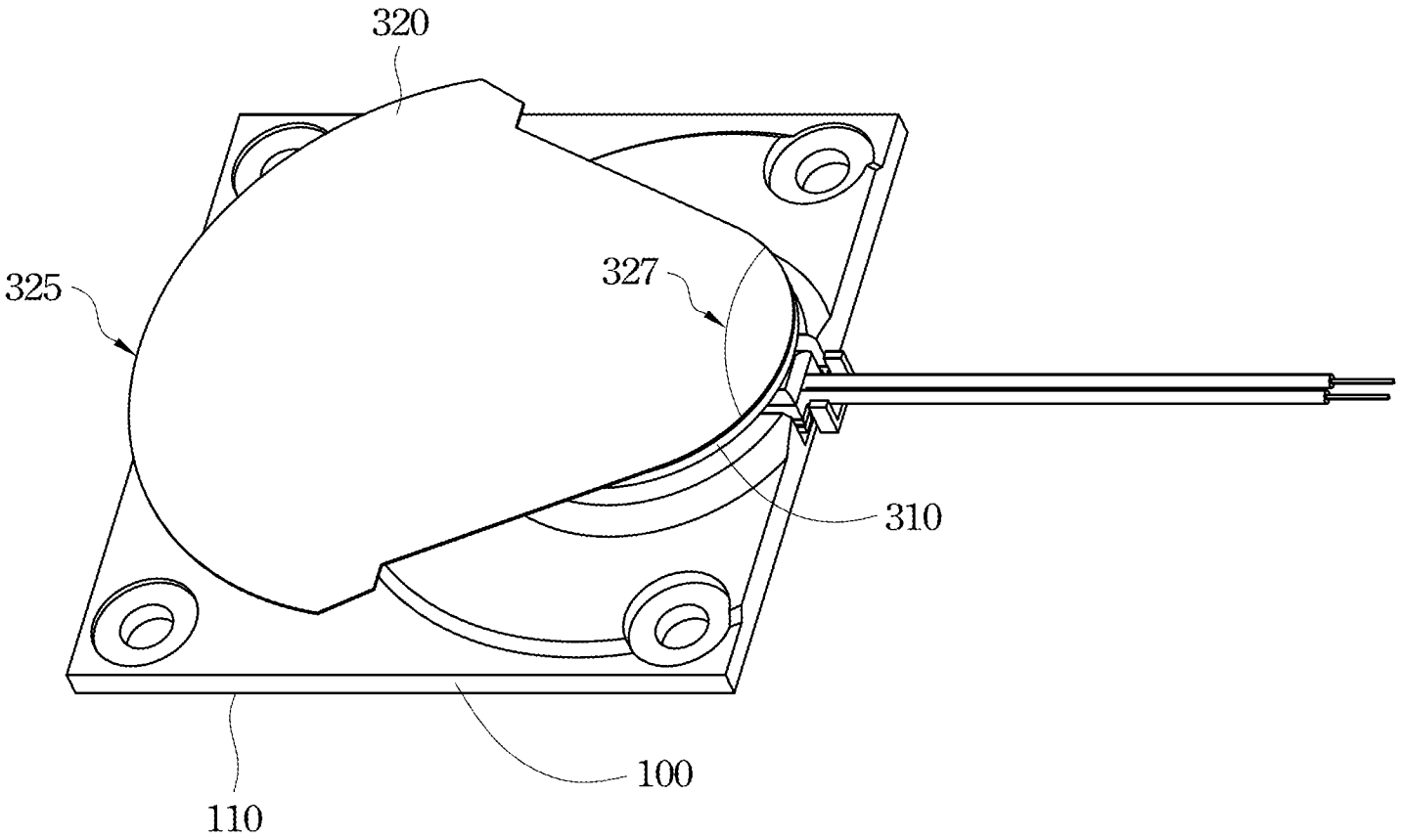
FIG. 7 is a perspective view of the vibration fan in accordance with one embodiment of the present invention.

FIG. 7 is a perspective view of the vibration fan in accordance with one embodiment of the present invention. In this embodiment, the blade body 320 includes a rim 325. The rim 325 is located away from the blade mount 310. The rim 325 substantially forms an arc. The blade body 320 includes a central angle 327 formed corresponding to the rim 325. In some embodiments, the central angle 327 ranges from about 30 degrees to about 150 degrees. For example, the central angle 327 can be about 60 degrees as shown in FIG. 7.

It should be noted that while the rim 325 is described above as substantially forming an arc, this not only includes an embodiment where the rim 325 is a smooth arc-shaped curve, but also includes embodiments where the rim 325 is formed by a plurality of straight lines connected similar to an arc-shaped curve (See the rim 325 shown in FIG. 7).

As shown in FIG. 7, in this embodiment, the base 100 includes a bottom edge 110. The distance between the rim 325 of the blade body 320 and the blade mount 310 is substantially the same as the length of the bottom edge 110, so as to increase the oscillating range of the blade body 320.

Figure 8:
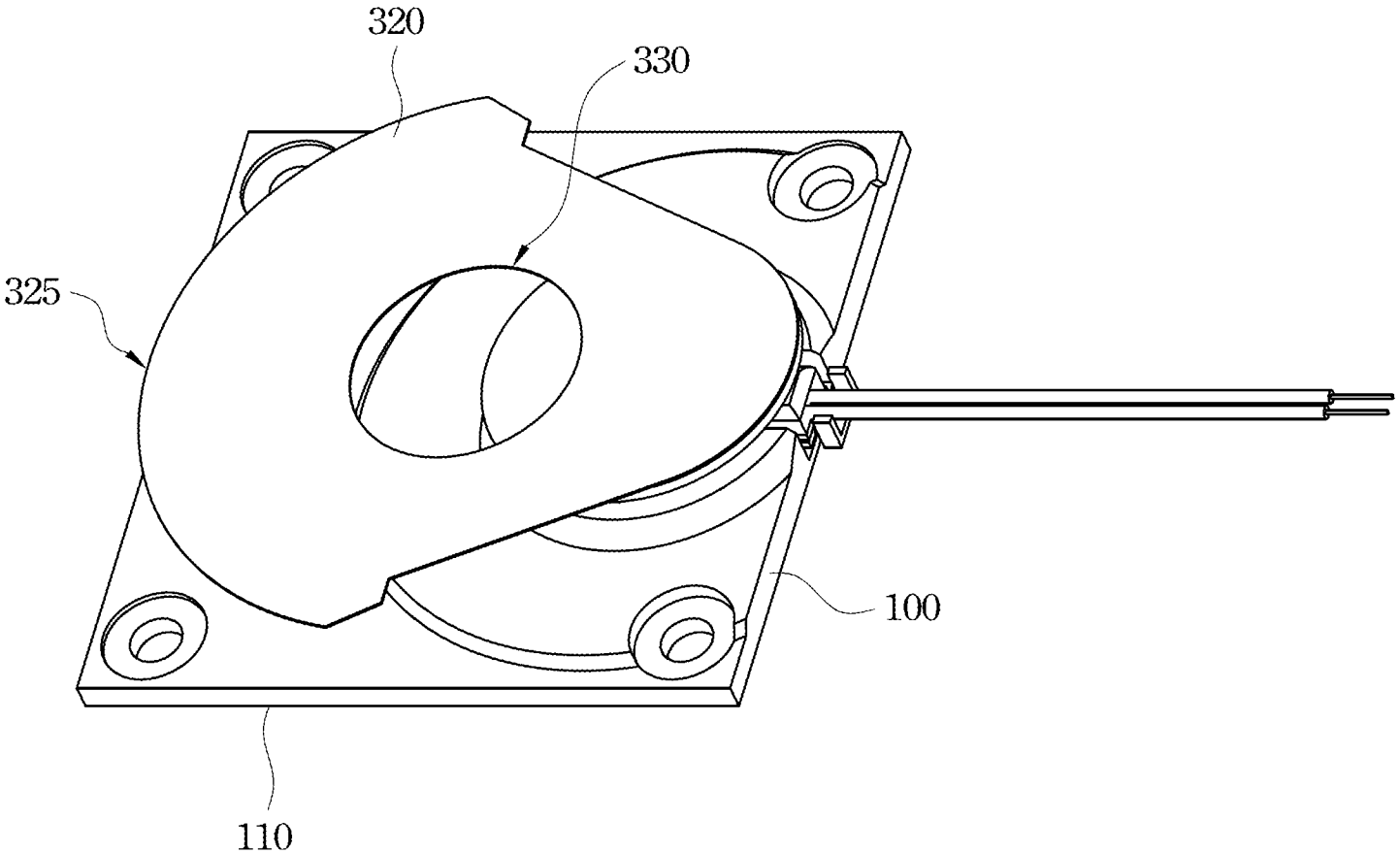
FIG. 8 is a perspective view of the vibration fan in accordance with another embodiment of the present invention.

FIG. 8 is a perspective view of the vibration fan in accordance with another embodiment of the present invention. This embodiment is similar to that of FIG. 7, and the main difference is that the vibration fan of this embodiment may further include at least one through hole 330. The through hole 330 is formed in the blade body 320. Specifically, the through hole 330 is formed extending through a portion of the blade body 320. In some embodiments, the through hole 330 may circular, elliptical, fan-shaped, or polygonal, but the present invention is not limited in this regard.

Figure 9:
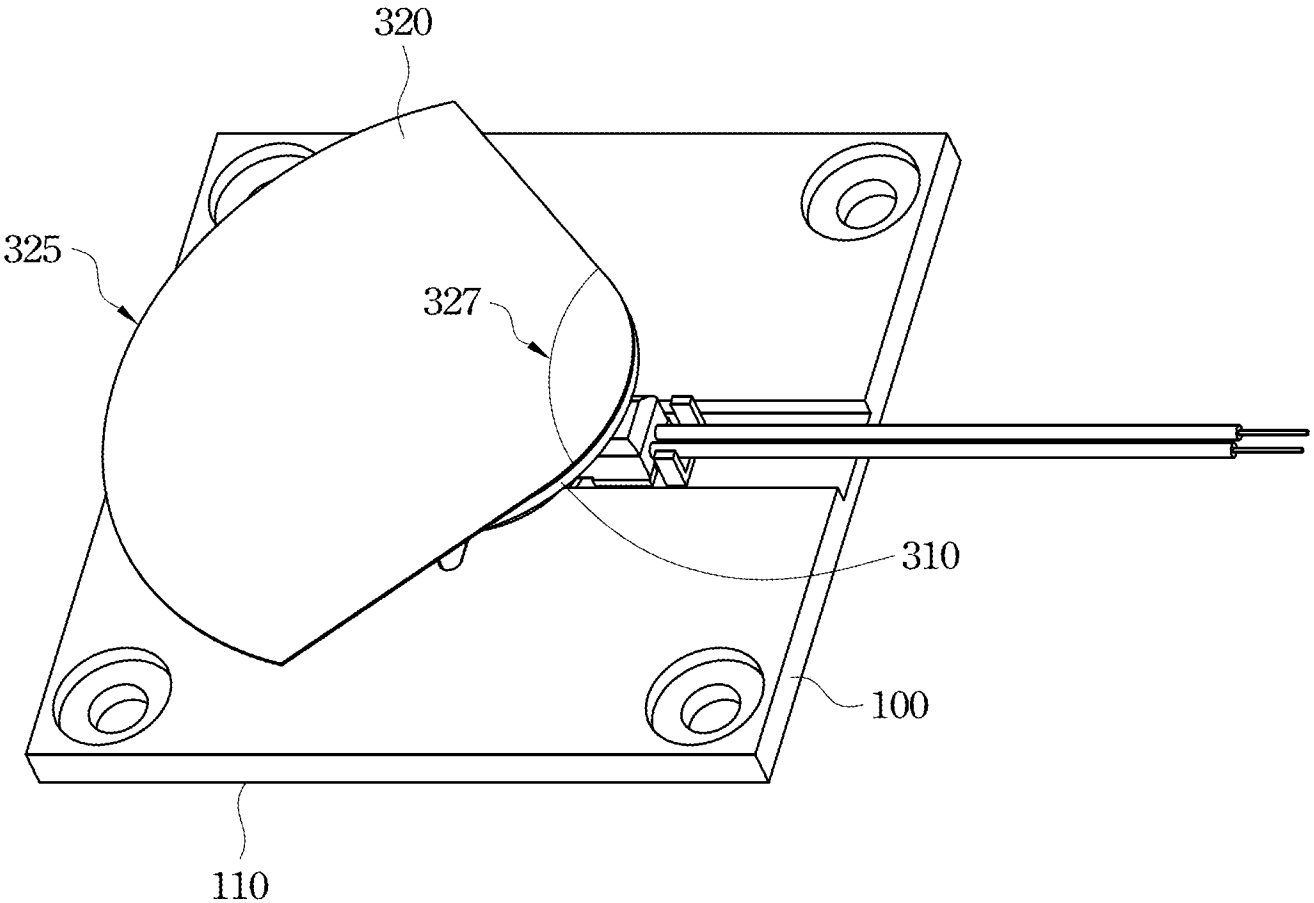
FIG. 9 is a perspective view of the vibration fan in accordance with another embodiment of the present invention.

FIG. 9 is a perspective view of the vibration fan in accordance with another embodiment of the present invention. This embodiment is similar to FIG. 7, and the main difference is that the blade mount 310 of this embodiment is approximately located at the center of the base 100. Specifically, the distance between the rim 325 of the blade body 320 and the blade mount 310 is approximately half the length of the bottom edge 110 of the base 100. Therefore, the central angle 327 corresponding to the rim 325 is double the central angle 327 in FIG. 7. For example, the central angle 327 in FIG. 9 is about 120 degrees.

Figure 10:
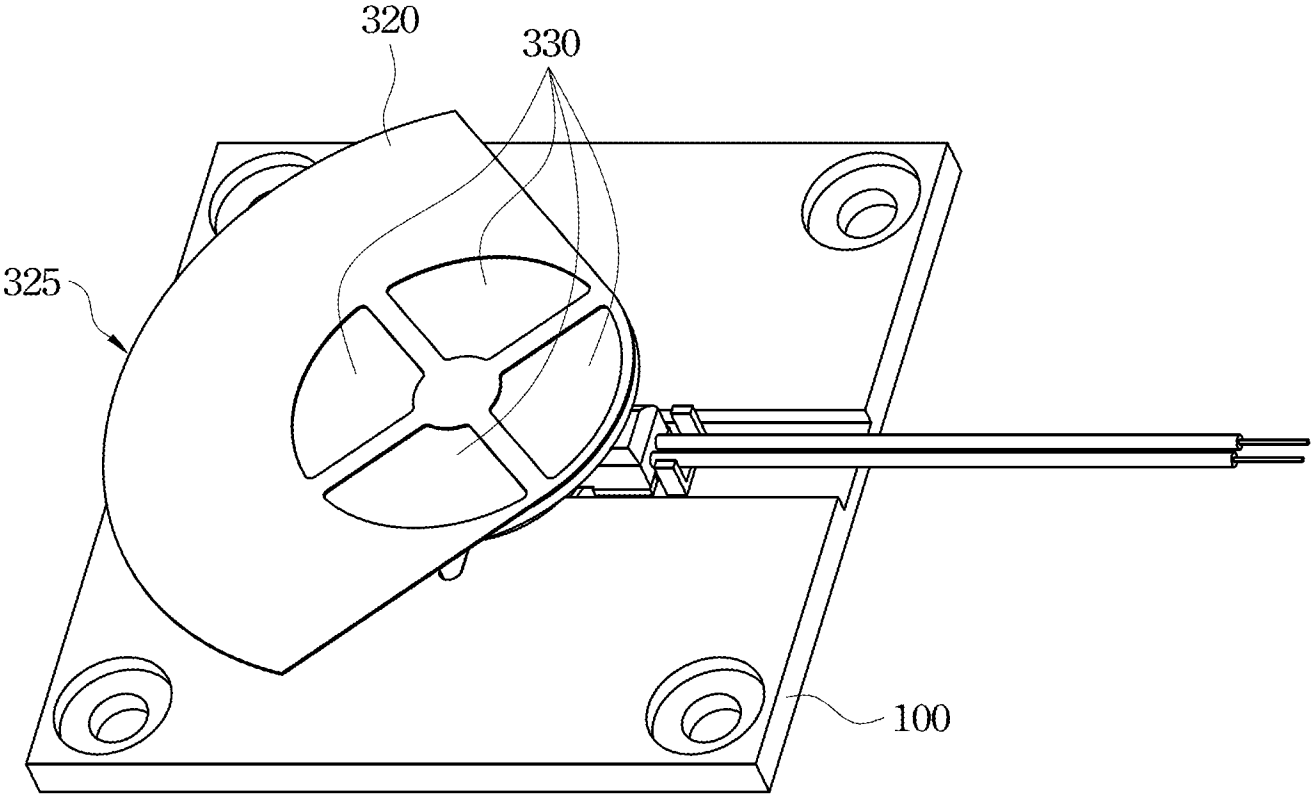
FIG. 10 is a perspective view of the vibration fan in accordance with another embodiment of the present invention.

FIG. 10 is a perspective view of the vibration fan in accordance with another embodiment of the present invention. This embodiment is similar to FIG. 9, and the main difference is that the vibration fan of this embodiment may further include a plurality of through holes 330. The through holes 330 are formed in the blade body 320. In some embodiments, each of the through holes 330 may be circular, elliptical, fan-shaped, or polygonal, but the present invention is not limited in this regard.

Figure 11:
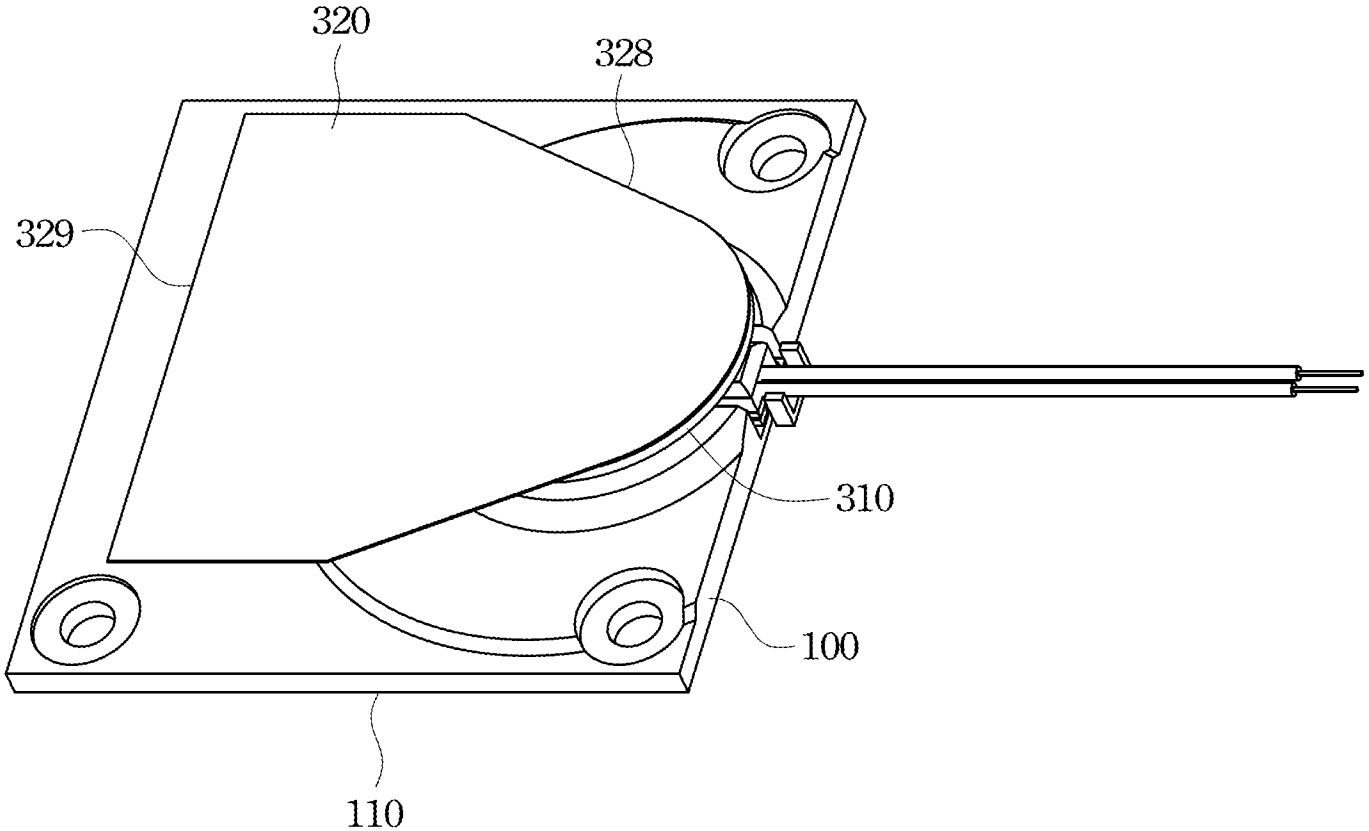
FIG. 11 is a perspective view of the vibration fan in accordance with another embodiment of the present invention.

FIG. 11 is a perspective view of the vibration fan in accordance with another embodiment of the present invention. This embodiment is similar to FIG. 7, and the main difference is that the blade body 320 of this embodiment includes a fan-shaped area 328 and a rectangular area 329. The fan-shaped area 328 is disposed on the blade mount 310. The rectangular area 329 is connected to the fan-shaped area 328.

Figure 12:
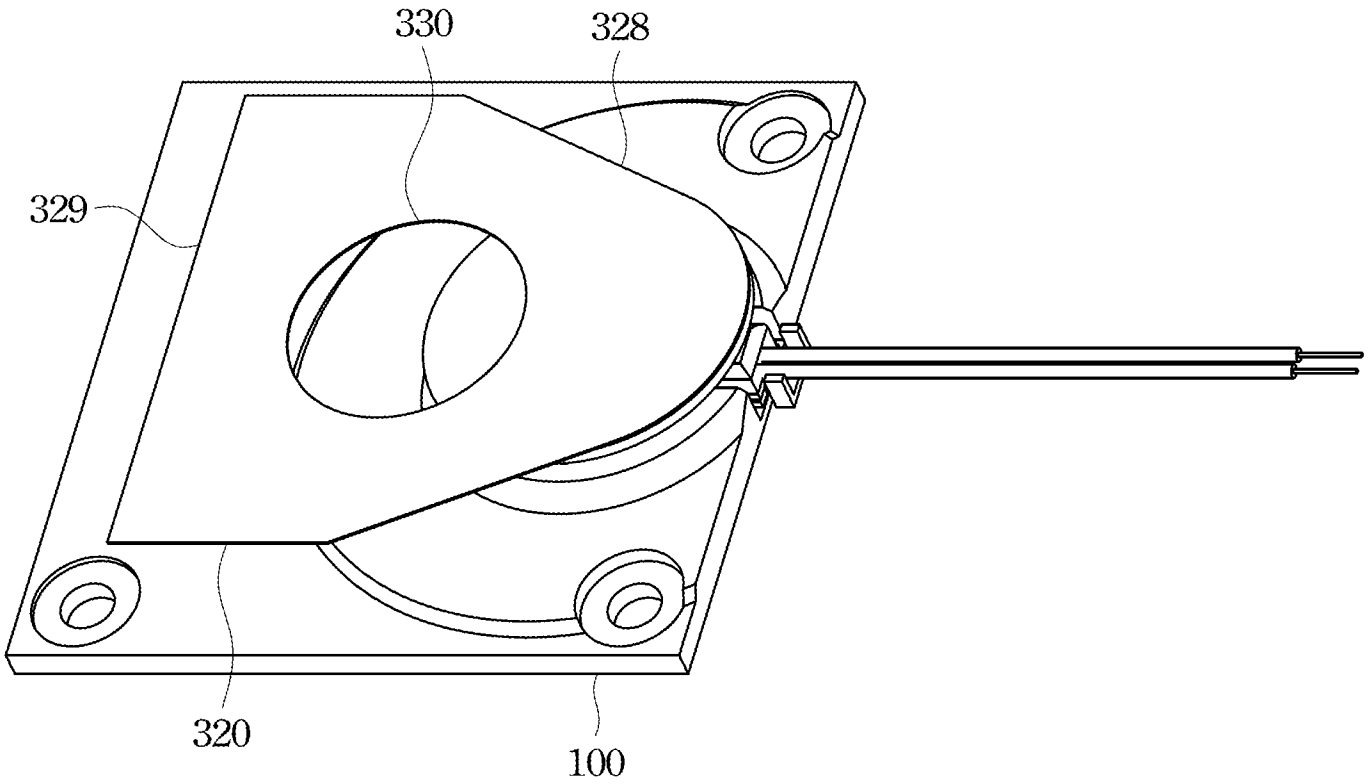
FIG. 12 is a perspective view of the vibration fan in accordance with another embodiment of the present invention.

FIG. 12 is a perspective view of the vibration fan in accordance with another embodiment of the present invention. This embodiment is similar to FIG. 11, and the main difference is that the vibration fan of this embodiment may further include at least one through hole 330. The through hole 330 is formed in the blade body 320. In some embodiments, the through hole 330 is circular, elliptical, fan-shaped, or polygonal, but the present invention is not limited in this regard.

Figure 13:
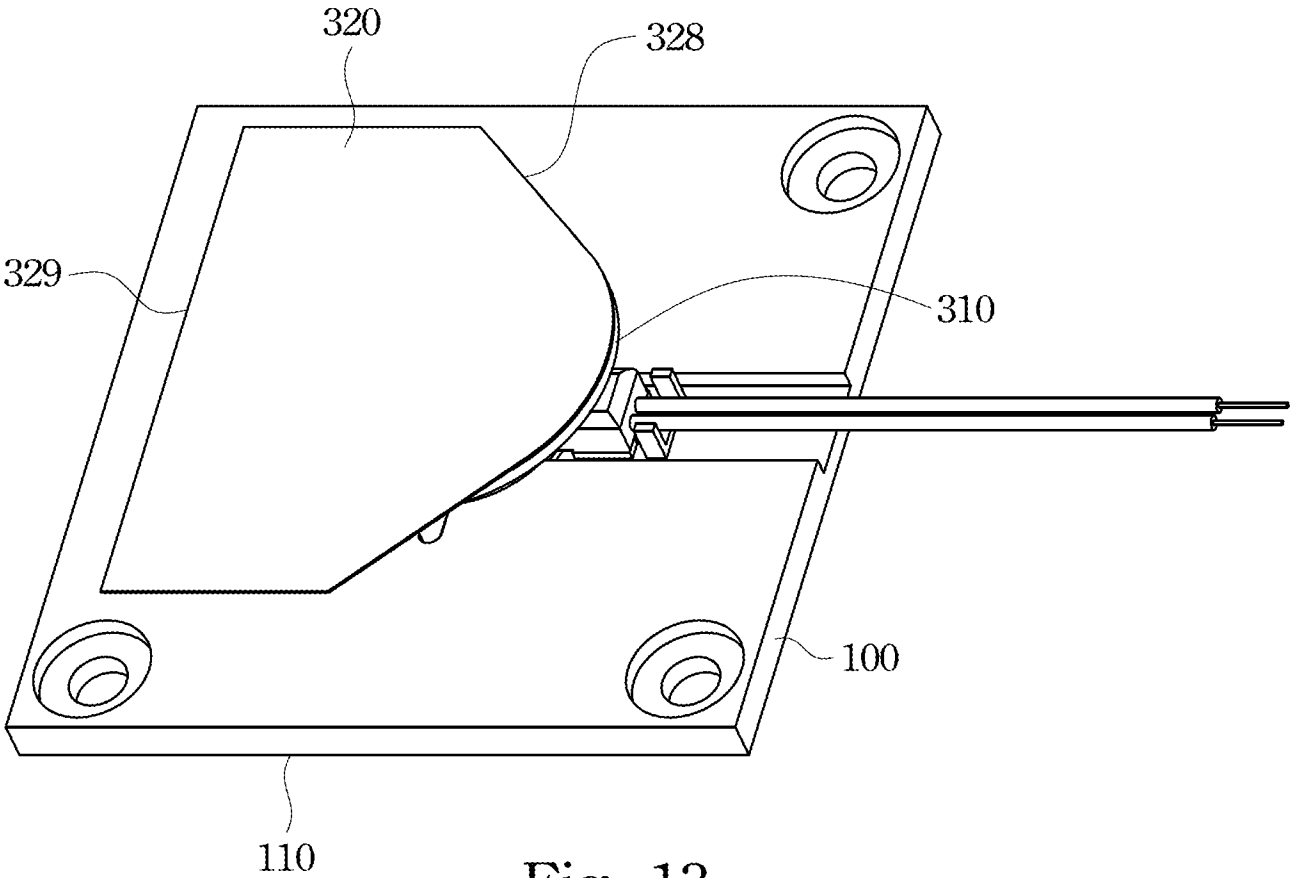
FIG. 13 is a perspective view of the vibration fan in accordance with another embodiment of the present invention.

FIG. 13 is a perspective view of the vibration fan in accordance with another embodiment of the present invention. This embodiment is similar to FIG. 11, and the main difference is that the blade mount 310 of this embodiment is approximately located at the center of the base 100.

Figure 14:
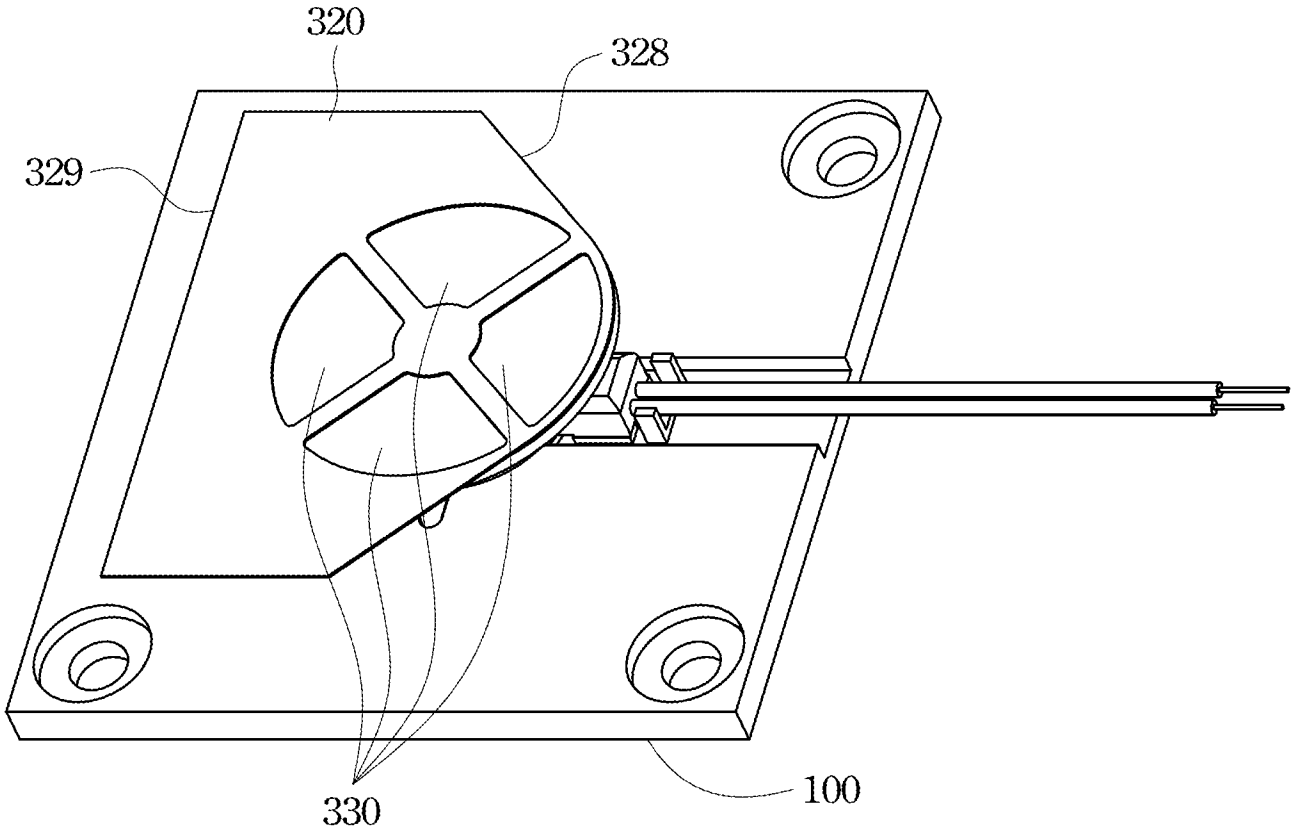
FIG. 14 is a perspective view of the vibration fan in accordance with another embodiment of the present invention.

FIG. 14 is a perspective view of the vibration fan in accordance with another embodiment of the present invention. This embodiment is similar to FIG. 13, and the main difference is that the vibration fan of this embodiment may further include a plurality of through holes 330. The through holes 330 are formed in the blade body 320. In some embodiments, each of the through holes 330 may be circular, elliptical, fan-shaped, or polygonal, but the present invention is not limited in this regard.

Referring back to FIG. 1, in some embodiments, the maximum distance between the blade 300 and the base 100 is less than about 4 mm. Specifically, when the blade body 320 (See FIG. 5) of the blade 300 moves upwards to the uppermost point, the distance between the blade body 320 and the lower surface of the base 100 is less than 4 mm. This distance can be modified depending on the required air flow and requirements related to the thickness of the vibration fan. In some embodiments, the maximum distance between the blade 300 and the base 100 is about 3 mm.

In some embodiments, the frequency of the reciprocation of the movable magnetic component 210 ranges from about 30 Hz to about 100 Hz. In some embodiments, the frequency of the reciprocation of the movable magnetic component 210 is about 60 Hz.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A vibration fan, comprising:

a base;

an electromagnetic actuator disposed on the base, the electromagnetic actuator comprising:

a fixed magnetic component; and a movable magnetic component being driven by a magnetic force between the movable magnetic component and the fixed magnetic component to reciprocate relative to the fixed magnetic component along a vibration direction;

a blade connected to the movable magnetic component; and two position-limiting elastic sheets for limiting movement of the movable magnetic component, wherein the moveable magnetic component is sandwiched between the position-limiting elastic sheets, the position-limiting elastic sheets and the moveable magnetic component are arranged along the vibration direction, one of the position-limiting elastic sheets is pressed and deformed by the movable magnetic component and another of the position-limiting elastic sheets is spaced apart from the movable magnetic component and does not deform when the movable magnetic component moves along the vibration direction.

2. The vibration fan of claim 1, wherein the fixed magnetic component is fixed on the base and surrounds the movable magnetic component.

3. The vibration fan of claim 2, wherein the movable magnetic component comprises a magnet, and the fixed magnetic component comprises a coil, and the magnet axially moves relative to the coil when the coil is conducting.

4. The vibration fan of claim 3, wherein a direction of the current conducting in the coil is substantially perpendicular to magnetic field lines of the magnet.

5. The vibration fan of claim 1, further comprising:

two protrusions disposed on opposite sides of the movable magnetic component and respectively pressing against the position-limiting elastic sheets.

6. The vibration fan of claim 1, further comprising:

a buffering space formed in the base, one of the position-limiting elastic sheets deforming towards the buffering space.

7. he vibration fan of claim 6, wherein the movable magnetic component extends into the buffering space.

8. The vibration fan of claim 1, wherein the blade comprises:

a blade mount connected to the movable magnetic component; and a blade body disposed on the blade mount.

9. The vibration fan of claim 8, wherein the blade body comprises:

a fixed part fixed on the blade mount; and a free part connected to the fixed part, movement of the free part being greater than movement of the movable magnetic component.

10. The vibration fan of claim 9, wherein the free part is made of elastic material.

11. The vibration fan of claim 8, wherein a main surface of the blade body is substantially perpendicular to a movement direction of the movable magnetic component.

12. The vibration fan of claim 11, wherein the blade mount deviates from a central line of the main surface of the blade body.

13. The vibration fan of claim 8, wherein the blade body comprises a rim located away from the blade mount, and the rim substantially forms an arc.

14. The vibration fan of claim 13, wherein a central angle of the rim ranges from about 30 degrees to about 150 degrees.

15. The vibration fan of claim 8, wherein the blade body comprises:

a fan-shaped area on the blade mount; and a rectangular area connected to the fan-shaped area.

16. The vibration fan of claim 8, further comprising:

at least one through hole formed in the blade body.

17. The vibration fan of claim 1, wherein a frequency of reciprocation of the movable magnetic component ranges from about 30 Hz to about 100 Hz.

18. The vibration fan of claim 1, wherein a maximum distance between the blade and the base is 4 mm.

* * * * *